US011199092B2

(12) United States Patent
Jiang et al.

(10) Patent No.: US 11,199,092 B2
(45) Date of Patent: Dec. 14, 2021

(54) HARD ROCK ROADWAY AND TUNNEL BORING MACHINE WITH ACTIVELY ROTATING HOBS

(71) Applicant: China University of Mining and Technology, Jiangsu (CN)

(72) Inventors: Hongxiang Jiang, Jiangsu (CN); Songyong Liu, Jiangsu (CN); Zhencai Zhu, Jiangsu (CN); Changlong Du, Jiangsu (CN)

(73) Assignee: China University of Mining and Technology, Jiangsu (CN)

( * ) Notice: Subject to any disclaimer, the term of this patent is extended or adjusted under 35 U.S.C. 154(b) by 0 days.

(21) Appl. No.: 16/764,405

(22) PCT Filed: Sep. 12, 2019

(86) PCT No.: PCT/CN2019/105595
§ 371 (c)(1),
(2) Date: May 15, 2020

(87) PCT Pub. No.: WO2020/211276
PCT Pub. Date: Oct. 22, 2020

(65) Prior Publication Data

US 2021/0231013 A1 Jul. 29, 2021

(30) Foreign Application Priority Data

Apr. 19, 2019 (CN) ..... 201910319026.5

(51) Int. Cl.
*E21D 9/10* (2006.01)
*E21D 9/08* (2006.01)
(Continued)

(52) U.S. Cl.
CPC ..... *E21D 9/1066* (2013.01); *E21D 9/0875* (2016.01); *E21D 9/1013* (2013.01);
(Continued)

(58) Field of Classification Search
CPC ..... E21D 9/1013; E21D 9/102; E21D 9/1066; E21D 9/0875; E21D 9/116; E21D 9/1006;
(Continued)

(56) References Cited

U.S. PATENT DOCUMENTS 3,326,607 A * 6/1967 Book ..... B05B 3/02 299/58
3,356,167 A * 12/1967 Trent ..... E21B 10/06 175/95
(Continued)

FOREIGN PATENT DOCUMENTS

CN 102953729 3/2013
CN 108086990 5/2018
(Continued)

OTHER PUBLICATIONS

"International Search Report (Form PCT/ISA/210) of PCT/CN2019/105595," dated Jan. 15, 2020, pp. 1-5.

*Primary Examiner* — Janine M Kreck
*Assistant Examiner* — Michael A Goodwin
(74) *Attorney, Agent, or Firm* — JCIPRNET

(57) ABSTRACT

The present invention discloses a hard rock roadway and tunnel boring machine with actively rotating hobs, including a rack provided with a crawler track unit. The rack is provided with a hydraulic power unit and a high-pressure abrasive jet generation system connected therewith. A transmission box is fixedly arranged at one of ends of the rack. The transmission box is provided with two input shafts and one output shaft. The input shafts are connected with planetary reduction mechanisms. Input ends of the planetary reduction mechanisms are connected with cantilever disc driving motors. A cantilever disc is fixed to the output shaft. Four cantilevers are hinged to the cantilever disc. Cantilever driving motors are further arranged on the cantilever disc. Actively rotating hob devices are arranged at ends of the
(Continued)

cantilevers away from the cantilever disc. The transmission box is further provided with rotary sealing devices.

3 Claims, 3 Drawing Sheets

(51) Int. Cl.
*E21D 9/11* (2006.01)
*E21C 25/60* (2006.01)
*E21C 35/23* (2006.01)
*E21C 35/187* (2006.01)

(52) U.S. Cl.
CPC ..... *E21D 9/116* (2013.01); *E21C 25/60* (2013.01); *E21C 35/187* (2013.01); *E21C 35/23* (2013.01)

(58) Field of Classification Search
CPC ..... E21D 9/104; E21D 9/1086; E21D 9/08; E21D 9/087; E21D 9/0879; E21C 35/226; E21C 25/60; E21C 35/23; E21C 35/187
See application file for complete search history.

(56) References Cited

U.S. PATENT DOCUMENTS 3,382,002 A * 5/1968 Tabor ..... E21D 9/0879 299/33
3,695,717 A * 10/1972 Birrer ..... F15B 11/16 299/31
3,799,615 A * 3/1974 Taylor ..... E21D 9/1066 299/59
4,190,294 A * 2/1980 Fikse ..... E21D 9/1093 299/33
4,298,230 A * 11/1981 Krabbe ..... E21D 9/0879 299/33
4,349,230 A * 9/1982 Hamburger ..... E21D 9/0875 299/33
4,607,889 A * 8/1986 Hagimoto ..... E21D 9/124 175/62
4,805,963 A * 2/1989 Kogler ..... E21D 9/1026 299/33
5,340,199 A * 8/1994 Piefenbrink ..... E21D 9/1006 299/10
6,332,652 B1 * 12/2001 Nakakuro ..... E21C 35/23 299/1.8
2010/0164274 A1 * 7/2010 Kondo ..... E21D 9/117 299/31

FOREIGN PATENT DOCUMENTS

CN 108756926 11/2018
CN 108868809 11/2018
CN 110056363 7/2019
EP 1760256 3/2007

* cited by examiner

HARD ROCK ROADWAY AND TUNNEL BORING MACHINE WITH ACTIVELY ROTATING HOBS

CROSS-REFERENCE TO RELATED APPLICATION

This application is a 371 of international application of PCT application serial no. PCT/CN2019/105595, filed on Sep. 12, 2019, which claims the priority benefit of China application no. 201910319026.5, filed on Apr. 19, 2019. The entirety of each of the above mentioned patent applications is hereby incorporated by reference herein and made a part of this specification.

BACKGROUND

Technical Field

The present invention relates to the field of tunnel boring machine devices, in particular to a hard rock roadway and tunnel boring machine with actively rotating hobs.

Description of Related Art

The energy industry is a basic industry of national economy, also a technology-intensive industry. "Safety, high-efficiency and low-carbon" intensively embody the characteristics of modern energy technologies, and are also a main direction to seize commanding heights of energy technologies in the future. China requires that with enhancement of the independent innovation ability as a focus, unlimited science and technology are utilized to break constraints of limited energy and resources to put forth effort to improve safe and efficient development of energy resources and promote revolution of energy production and utilization methods. China plans to treat energy exploration and mining technologies as one of four key development areas, and clearly requires developing safe, efficient, economical and environment-friendly mining technologies and equipment for resources under complex geological conditions, such as developing and manufacturing boring machines for rock with 200 MPa compressive strength, and efficient downhole power and rock breaking systems. With wide application of all kinds of rock excavation machines in actual engineering such as mining, tunnel boring and oil and gas well drilling, higher requirements and new challenges are put forward for hard rock breaking technologies. Mechanical rock breaking has the advantages of large breaking blocks, high operation efficiency and the like, and has been widely applied to fields such as mining, constructional engineering and resource exploration. However, when existing equipment is applied in hard rock mass boring construction, tool wear is increased, reliability and work efficiency are reduced, how to achieve efficient breaking of hard rock has become a question and problem urgent to be solved, it is urgent to study new rock breaking methods to achieve efficient breaking of the hard rock, and it is of vitally important significance to achieve efficient mining of mines, efficient boring of tunnels and even efficient development of China's energy resources. In the past, mechanical breaking of the hard rock is achieved mainly by increasing mechanical drive power, but the rock breaking ability of mechanical tools has not changed. Only increasing power will lead to wear acceleration of rock breaking mechanisms and increasing of dust amount of a working face. Mechanical rock breaking efficiency is difficult to be effectively improved, and potential safety hazards are increased.

SUMMARY

Aiming at the above technical deficiencies, the present invention aims to provide a hard rock roadway and tunnel boring machine with actively rotating hobs, which can solve the problems of serious equipment wear, low rock breaking efficiency, large dust amount and the like under the situation of hard rock mass existing in a roadway or tunnel construction process, so that safe, efficient and low-cost boring of a hard rock mass roadway is achieved.

In order to solve the above technical problems, the present invention adopts the following technical solution:

The present invention provides the hard rock roadway and tunnel boring machine with the actively rotating hobs, including a rack provided with a crawler track unit. The rack is provided with a hydraulic power unit and a high-pressure abrasive jet generation system connected therewith. A transmission box is fixedly arranged at one of ends of the rack. Two sides of the transmission box are respectively provided with two input shafts and one output shaft. The input shafts are connected with planetary reduction mechanisms. Input ends of the planetary reduction mechanisms are connected with cantilever disc driving motors. A cantilever disc is fixed to the output shaft. Four cantilevers are hinged to the cantilever disc. Cantilever driving motors configured to control rotation angles of the cantilevers are further arranged on the cantilever disc. Actively rotating hob devices are arranged at ends of the cantilevers away from the cantilever disc. The transmission box is further provided with rotary sealing devices. The rotary sealing devices are respectively connected with the hydraulic power unit and the high-pressure abrasive jet generation system through pipelines. The cantilever disc driving motors are connected with the hydraulic power unit through pipelines. The actively rotating hob devices and the cantilever driving motors are respectively connected with the transmission box through pipelines.

Preferably, the rotary sealing device includes a second shell and a sealing shaft matched therewith. The second shell is provided with a hydraulic oil inlet, a hydraulic oil return opening and a first high-pressure abrasive liquid inlet. The sealing shaft is respectively provided with a first oil inlet flow channel communicating with the hydraulic oil inlet, a first oil return flow channel communicating with the hydraulic oil return opening, and a first abrasive liquid flow channel communicating with the first high-pressure abrasive liquid inlet. The hydraulic oil inlets and the hydraulic oil return openings are connected with the hydraulic power unit. The first high-pressure abrasive liquid inlets are connected with the high-pressure abrasive jet generation system. The sealing shaft is provided with a plurality of first sealing rings isolating the first oil inlet flow channel, the first oil return flow channel and the first abrasive liquid flow channel.

Preferably, the transmission box further includes a first shell and a transmission gear arranged in the first shell. The input shafts are in transmission connection with the output shaft through the transmission gear. A second oil inlet flow channel communicating with the first oil inlet flow channels, a second oil return flow channel communicating with the first oil return flow channels and a second abrasive liquid flow channel communicating with the first abrasive liquid flow channels are respectively formed in the output shaft. The first shell is fixedly connected with the second shells. The output shaft is fixedly connected with the sealing shafts.

Preferably, the actively rotating hob devices include driving motors provided with double extending shafts. The driving motors are fixed to the cantilevers. Front extending ends of the double extending shafts are connected with the hobs. Rear extending ends of the double extending shafts are provided with second sealing rings and sealed through sealing shells. The sealing shells are fixed to the driving motors. Oil inlets and oil return openings of the driving motors respectively communicate with the second oil inlet flow channel and the second oil return flow channel through rubber pipes. Third abrasive liquid flow channels are formed in the double extending shafts. The hobs and the sealing shells are respectively provided with fourth abrasive liquid flow channels communicating with the third abrasive liquid flow channels, and second high-pressure abrasive liquid inlets. The second high-pressure abrasive liquid inlets communicate with the second abrasive liquid flow channel through rubber pipes. A plurality of nozzles are mounted at outer edges of the hobs. The nozzles communicate with the fourth abrasive liquid flow channels.

Preferably, an included angle between a central axis of the hob and a central axis of the cantilever disc is 15°-30°.

Preferably, both the first sealing rings and the second sealing rings are made of polytetrafluoroethylene.

Preferably, the crawler track unit is driven by high-pressure oil liquid of the hydraulic power unit.

The present invention has the following beneficial effects: when the device works, the nozzles mounted on the actively rotating hob devices spray high-speed abrasive jets out to pre-slot contact positions of the hobs and rock, then the hobs are utilized to cut and break the rock, and efficient cutting and breaking of the rock are completed by utilizing the characteristic of low tensile strength of the rock, so that the rock breaking difficulty of the hobs is greatly reduced, and the breaking efficiency of the hard rock mass is improved. The mechanism may reduce the breaking difficulty of the hard rock mass and improve the boring efficiency of the hard rock mass, and is of important significance to achieve efficient boring of the hard rock roadway and tunnel.

BRIEF DESCRIPTION OF THE DRAWINGS

To describe the technical solutions in embodiments of this application or in the existing technology more clearly, the following briefly describes the accompanying drawings required for describing the embodiments or the existing technology. Apparently, the accompanying drawings in the following description show merely some embodiments of the present disclosure, and a person of ordinary skill in the art may derive other drawings from these accompanying drawings without creative efforts.

DESCRIPTIONS OF REFERENCE NUMERALS ARE AS FOLLOWS

1 denotes a crawler track unit; 2 denotes a rack; 3 denotes a hydraulic power unit; 4 denotes a high-pressure abrasive jet generation system; 5 denotes a cantilever disc driving motor; 6 denotes a planetary reduction mechanism; 7 denotes a transmission box; 7-1 denotes a first shell; 7-2 denotes an input shaft; 7-3 denotes a transmission gear; 7-4 denotes an output shaft; 7-4-1 denotes a second oil inlet flow channel; 7-4-2 denotes a second oil return flow channel; 7-4-3 denotes a second abrasive liquid flow channel; 8 denotes a cantilever disc; 9 denotes a cantilever; 10 denotes a cantilever driving motor; 11 denotes an actively rotating hob device; 11-1 denotes a driving motor; 11-2 denotes a second high-pressure abrasive liquid inlet; 11-3 denotes a double extending shaft; 11-4 denotes a front extending end; 11-5 denotes a hob; 11-6 denotes a rear extending end; 11-7 denotes a sealing shell; 11-8 denotes a third abrasive liquid flow channel; 11-9 denotes a fourth abrasive liquid flow channel; 11-10 denotes a nozzle; 11-11 denotes a second sealing ring; 12 denotes a rotary sealing device; 12-1 denotes a second shell; 12-2 denotes a sealing shaft; 12-3 denotes a first sealing ring; 12-1-1 denotes a hydraulic oil inlet; 12-1-2 denotes a hydraulic oil return opening; 12-1-3 denotes a first high-pressure abrasive liquid inlet; 12-2-1 denotes a first oil inlet flow channel; 12-2-2 denotes a first oil return flow channel; and 12-2-3 denotes a first abrasive liquid flow channel.

DESCRIPTION OF THE EMBODIMENTS

The following clearly and completely describes the technical solutions in the embodiments of the present invention with reference to the accompanying drawings in the embodiments of the present invention. Obviously, the described embodiments are only some embodiments instead of all embodiments of the present invention. All other embodiments obtained by a person of ordinary skill in the art based on the embodiments of the present invention without creative effects shall fall within the protection scope of the present invention.

Figure 1:
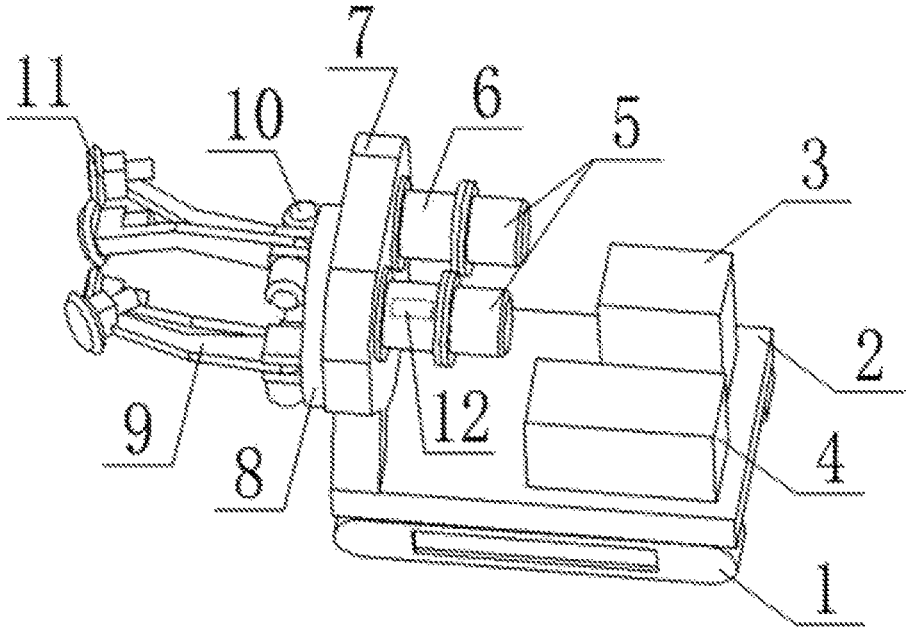
FIG. 1 is a schematic structural view of a hard rock roadway and tunnel boring machine with actively rotating hobs provided by an embodiment of the present invention.
Figure 5:
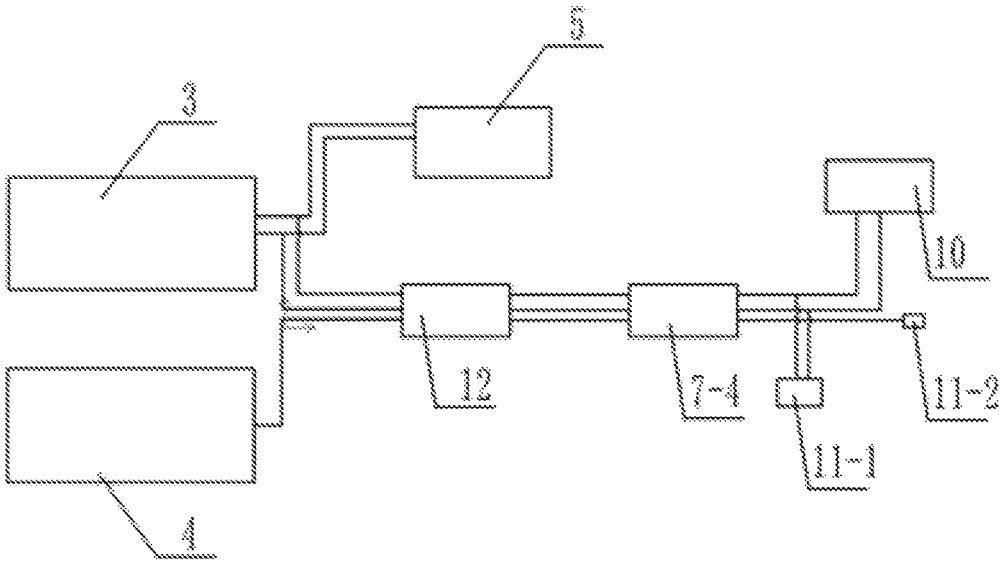
FIG. 5 is a pipeline connection diagram of a hydraulic power unit, a high-pressure abrasive jet generation system, a cantilever disc driving motor, the transmission box, a cantilever driving motor and the actively rotating hob device.

As shown in FIG. 1, a hard rock roadway and tunnel boring machine with actively rotating hobs includes a rack 2 provided with a crawler track unit 1. The rack 2 is provided with a hydraulic power unit 3 and a high-pressure abrasive jet generation system 4 connected therewith. A transmission box 7 is fixedly arranged at one of ends of the rack 2. Two sides of the transmission box 7 are respectively provided with two input shafts 7-2 and one output shaft 7-4. The input shafts 7-2 are connected with planetary reduction mechanisms 6. Input ends of the planetary reduction mechanisms 6 are connected with cantilever disc driving motors 5. A cantilever disc 8 is fixed to the output shaft 7-4. Four cantilevers 9 are hinged to the cantilever disc 8. Cantilever driving motors 10 configured to control rotation angles of the cantilevers 9 are further arranged on the cantilever disc 8. Actively rotating hob devices 11 are arranged at ends of the cantilevers 9 away from the cantilever disc 8. The transmission box 7 is further provided with rotary sealing devices 12. As shown in FIG. 5, the rotary sealing devices 12 are respectively connected with the hydraulic power unit 3 and the high-pressure abrasive jet generation system 4 through pipelines. The cantilever disc driving motors 5 are connected with the hydraulic power unit 3 through pipelines. The actively rotating hob devices 11 and the cantilever driving motors 10 are respectively connected with the transmission box 7 through pipelines.

Figure 3:
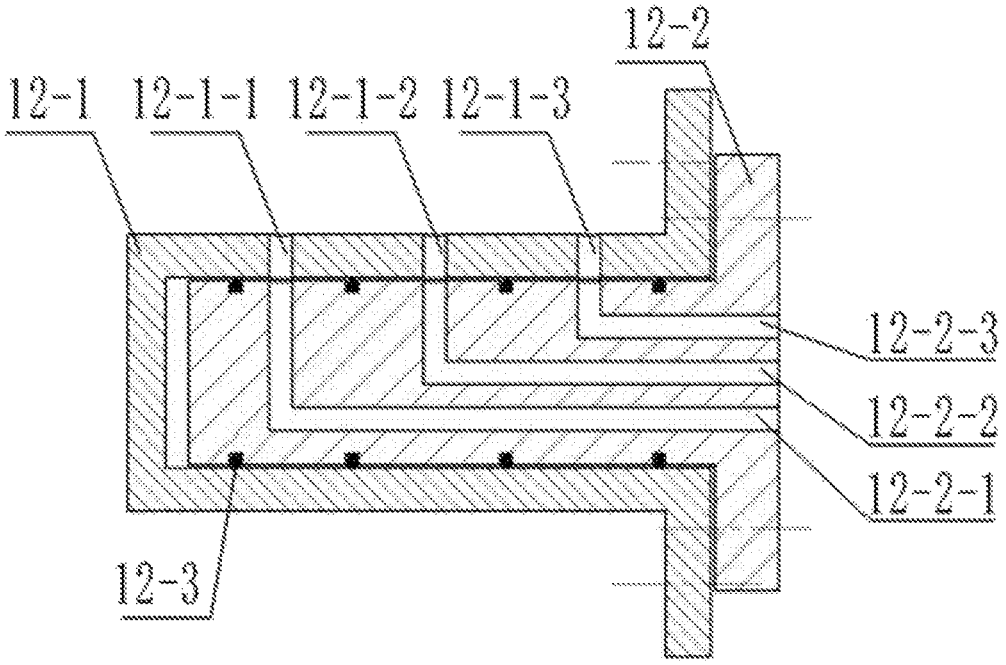
FIG. 3 is a sectional view of a rotary sealing device provided by an embodiment of the present invention.

As shown in FIG. 1 and FIG. 3, the rotary sealing device 12 includes a second shell 12-1 and a sealing shaft 12-2 matched therewith. The second shell 12-1 is provided with a hydraulic oil inlet 12-1-1, a hydraulic oil return opening 12-1-2 and a first high-pressure abrasive liquid inlet 12-1-3. The sealing shaft 12-2 is respectively provided with a first oil inlet flow channel 12-2-1 communicating with the hydraulic oil inlet 12-1-1, a first oil return flow channel 12-2-2 communicating with the hydraulic oil return opening 12-1-2, and a first abrasive liquid flow channel 12-2-3 communicating with the first high-pressure abrasive liquid inlet 12-1-3. The hydraulic oil inlets 12-1-1 and the hydraulic oil return openings 12-1-2 are connected with the hydraulic power unit 3. The first high-pressure abrasive liquid inlets 12-1-3 are connected with the high-pressure abrasive jet generation system 4. The sealing shaft 12-2 is provided with a plurality of first sealing rings 12-3 isolating the first oil inlet flow channel 12-2-1, the first oil return flow channel 12-2-2 and the first abrasive liquid flow channel 12-2-3.

Figure 2:
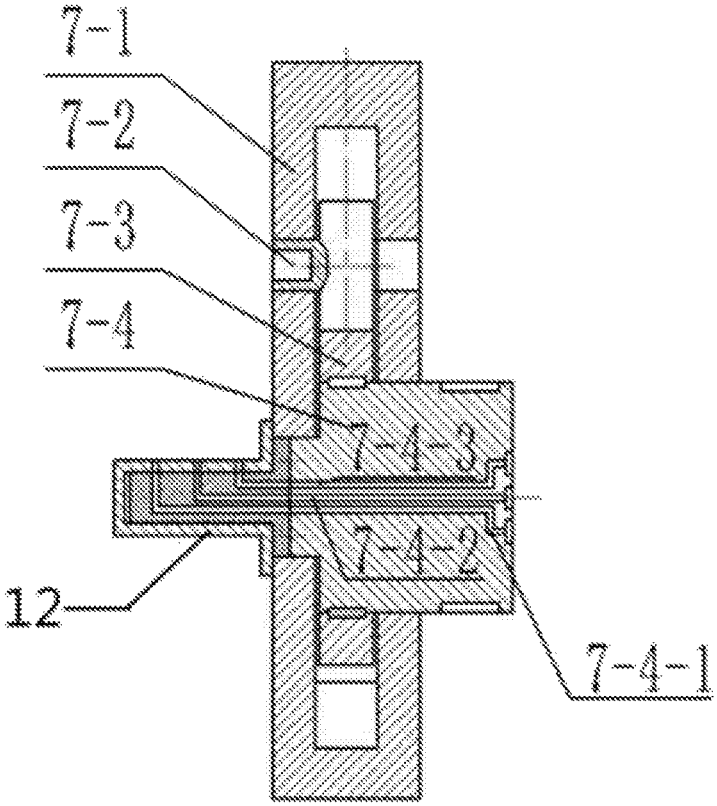
FIG. 2 is a sectional view of a transmission box provided by an embodiment of the present invention.

As shown in FIG. 1 and FIG. 2, the transmission box 7 further includes a first shell 7-1 and a transmission gear 7-3 arranged in the first shell 7-1. The input shafts 7-2 are in transmission connection with the output shaft 7-4 through the transmission gear 7-3. A second oil inlet flow channel 7-4-1 communicating with the first oil inlet flow channels 12-2-1, a second oil return flow channel 7-4-2 communicating with the first oil return flow channels 12-2-2 and a second abrasive liquid flow channel 7-4-3 communicating with the first abrasive liquid flow channels 12-2-3 are respectively formed in the output shaft 7-4. The first shell 7-1 is fixedly connected with the second shells 12-1. The output shaft 7-4 is fixedly connected with the sealing shafts 12-2.

Figure 4:
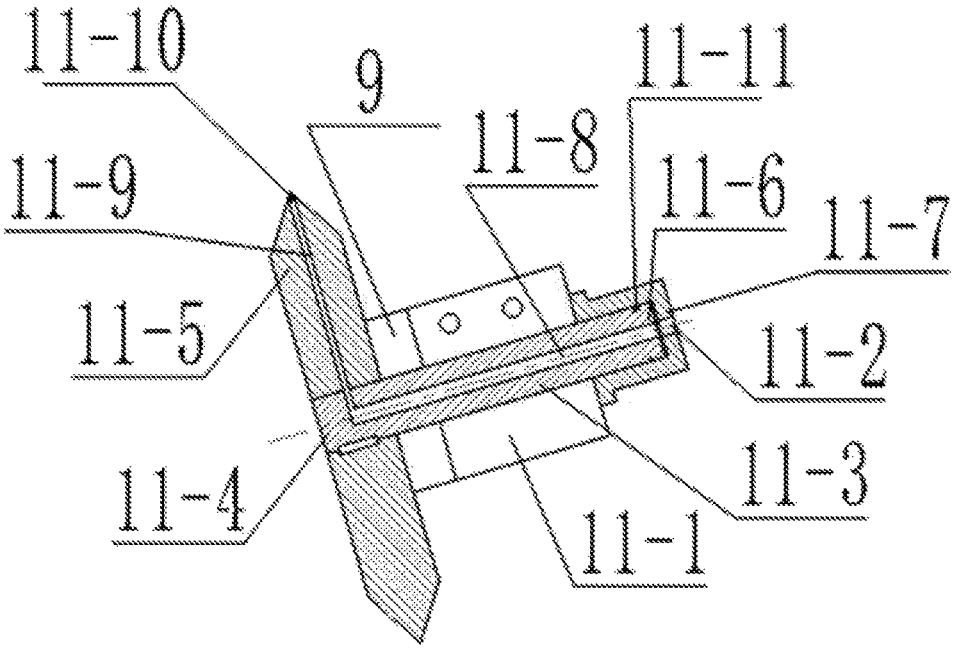
FIG. 4 is a sectional view of an actively rotating hob device provided by an embodiment of the present invention.

As shown in FIG. 1 and FIG. 4, the actively rotating hob devices 11 include driving motors 11-1 provided with double extending shafts 11-3. The driving motors 11-1 are fixed to the cantilevers 9. Front extending ends 11-4 of the double extending shafts 11-3 are connected with the hobs 11-5. Rear extending ends 11-6 of the double extending shafts 11-3 are provided with second sealing rings 11-11 and sealed through sealing shells 11-7. The sealing shells 11-7 are fixed to the driving motors 11-1. Oil inlets and oil return openings of the driving motors 11-1 respectively communicate with the second oil inlet flow channel 7-4-1 and the second oil return flow channel 7-4-2 through rubber pipes. Third abrasive liquid flow channels 11-8 are formed in the double extending shafts 11-3. The hobs 11-5 and the sealing shells 11-7 are respectively provided with fourth abrasive liquid flow channels 11-9 communicating with the third abrasive liquid flow channels 11-8, and second high-pressure abrasive liquid inlets 11-2. The second high-pressure abrasive liquid inlets 11-2 communicate with the second abrasive liquid flow channel 7-4-3 through rubber pipes. A plurality of nozzles 11-10 are mounted at outer edges of the hobs 11-5. The nozzles 11-10 communicate with the fourth abrasive liquid flow channels 11-9.

An included angle between a central axis of the hob 11-5 and a central axis of the cantilever disc 8 is 15°-30°.

Both the first sealing rings 12-3 and the second sealing rings 11-11 are made of polytetrafluoroethylene.

The crawler track unit 1 is driven by high-pressure oil liquid of the hydraulic power unit 3.

During working, the hydraulic power unit 3 provides the high-pressure oil liquid to the crawler track unit 1 to propel or move the boring machine, and the hydraulic power unit 3 further respectively provides the high-pressure oil liquid to the cantilever disc driving motors 5 and the rotary sealing devices 12. The high-pressure oil liquid passes through the hydraulic oil inlets 12-1-1 of the rotary sealing devices 12, then passes through the first oil inlet flow channels 12-2-1 of the sealing shafts 12-2, the second oil inlet flow channel 7-4-1 of the output shaft 7-4 of the transmission box 7 and the rubber pipes and is transmitted to the cantilever driving motors 10 and the driving motors 11-1, so that the cantilever driving motors 10 control swing angles of the cantilevers 9, the cantilever disc driving motors 5 achieve rotary motion of the cantilever disc 8 through the planetary reduction mechanisms 6 and the transmission box 7, and the hobs 11-5 actively rotate under the action of the driving motors 11-1. When the cantilever driving motors 10 lock the cantilevers 9, the cantilever disc 8, the driving motors 11-1 and the crawler track unit 1 simultaneously work to make the cantilever disc 8 and the hobs 11-5 simultaneously rotate, that is, boring rock-breaking may be achieved. The cantilever driving motors 10 may adjust postures of the cantilevers 9 according to the size of an end face of a roadway and tunnel, and the hobs 11-5 rotate itself to cut and break rock when the actively rotating hob devices 11 work, thereby achieving mechanical cutting and breaking of rock mass on a working face of the roadway and tunnel under the premise of the rotary motion of the cantilever disc 8.

High-pressure abrasive liquid formed after the high-pressure abrasive jet generation system 4 is energized passes through the first high-pressure abrasive liquid inlets 12-1-3 of the rotary sealing devices 12, sequentially passes through the first abrasive liquid flow channels 12-2-3, the second abrasive liquid flow channel 7-4-3 of the output shaft 7-4 in the transmission box 7, the second high-pressure abrasive liquid inlet 11-2, the third abrasive liquid flow channels 11-8 and the fourth abrasive liquid flow channels 11-9, and finally forms high-speed abrasive jets through the nozzles 11-10, so that in-advance rock slotting is conducted on a rock cutting and breaking path of the hobs to assist in rock breaking of the actively rotating hob devices 11, so as to reduce the difficulty of cutting and breaking hard rock by the actively rotating hob devices 11 and improve the boring efficiency of a hard rock roadway.

Apparently, persons skilled in the art may make various modifications and variations to the present disclosure without departing from the spirit and scope of the present disclosure. If these modifications and variations of the present disclosure belong to the scope of the claims of the present disclosure and equivalent technologies thereof, the present disclosure is also intended to cover these modifications and variations.

What is claimed is:

1. A hard rock roadway and tunnel boring machine with actively rotating hobs, comprising a rack provided with a crawler track unit, wherein the rack is provided with a hydraulic power unit and a high-pressure abrasive jet generation system connected to the hydraulic power unit, a transmission box is fixedly arranged at one end of the rack, two sides of the transmission box are respectively provided with two input shafts and one output shaft, the input shafts are connected with planetary reduction mechanisms, input ends of the planetary reduction mechanisms are connected with cantilever disc driving motors, a cantilever disc is fixed to the output shaft, four cantilevers are hinged to the cantilever disc, cantilever driving motors configured to control rotation angles of the cantilevers are further arranged on the cantilever disc, actively rotating hob devices are arranged at ends of the cantilevers away from the cantilever disc, the transmission box is further provided with a rotary sealing device, the rotary sealing device is connected with the hydraulic power unit and the high-pressure abrasive jet generation system through pipelines, the cantilever disc driving motors are connected with the hydraulic power unit through pipelines, and the actively rotating hob devices and the cantilever driving motors are respectively connected with the transmission box through pipelines, wherein the rotary sealing device comprises a second shell and a sealing shaft surrounded by the second shell, the second shell is provided with a hydraulic oil inlet, a hydraulic oil return opening and a first high-pressure abrasive liquid inlet, the sealing shaft is respectively provided with a first oil inlet flow channel communicating with the hydraulic oil inlet, a first oil return flow channel communicating with the hydraulic oil return opening, and a first abrasive liquid flow channel communicating with the first high-pressure abrasive liquid inlet, the hydraulic oil inlet and the hydraulic oil return opening are connected with the hydraulic power unit, the first high-pressure abrasive liquid inlet is connected with the high-pressure abrasive jet generation system, and the sealing shaft is provided with a plurality of first sealing rings isolating the first oil inlet flow channel, the first oil return flow channel and the first abrasive liquid flow channel, the transmission box further comprises a first shell and a transmission gear arranged in the first shell, the input shafts are in transmission connection with the output shaft through the transmission gear, a second oil inlet flow channel communicating with the first oil inlet flow channel, a second oil return flow channel communicating with the first oil return flow channel and a second abrasive liquid flow channel communicating with the first abrasive liquid flow channel are respectively formed in the output shaft, the first shell is fixedly connected with the second shell, and the output shaft is fixedly connected with the sealing shaft, the actively rotating hob devices comprise driving motors provided with double extending shafts, the driving motors are fixed to the cantilevers, front extending ends of the double extending shafts are connected with hobs, rear extending ends of the double extending shafts are provided with second sealing rings and sealed through sealing shells, the sealing shells are fixed to the driving motors, oil inlets and oil return openings of the driving motors respectively communicate with the second oil inlet flow channel and the second oil return flow channel through rubber pipes, third abrasive liquid flow channels are formed in the double extending shafts, the hobs and the sealing shells are respectively provided with fourth abrasive liquid flow channels communicating with the third abrasive liquid flow channels, and second high-pressure abrasive liquid inlets, the second high-pressure abrasive liquid inlets communicate with the second abrasive liquid flow channel through rubber pipes, a plurality of nozzles are mounted at outer edges of the hobs, and the nozzles communicate with the fourth abrasive liquid flow channels.

2. The hard rock roadway and tunnel boring machine with actively rotating hobs according to claim 1, wherein an included angle between a central axis of the hob and a central axis of the cantilever disc is in a range from 15° to 30°.

3. The hard rock roadway and tunnel boring machine with actively rotating hobs according to claim 1, wherein both the first sealing rings and the second sealing rings are made of polytetrafluoroethylene.

* * * * *